United States Patent [19]

Vorobeichikov et al.

[11] 4,212,630

[45] Jul. 15, 1980

[54] APPARATUS FOR REMOVING HEAT FROM CYLINDERS OF THE ROTARY KILN RECUPERATOR COOLER

[76] Inventors: Leonid T. Vorobeichikov, prospekt Gagarina, 80, kv. 132; Boris F. Fedoryakin, ulitsa Dzerzhinskogo, 46, kv. 11, both of Kharkov; Grigory K. Panchenko, ulitsa Gruzinova, 55, Bakhchisarai Krymskoi oblasti; Grigory N. Gorbanev, ulitsa Gagarina, 3, kv. 85, Bakhchisarai Krymskoi oblasti; Anatoly N. Bevz, ulitsa I. Strelnikova, 6, Bakhchisarai Krymskoi oblasti; Vladimir I. Satarin, prospekt Lenina, 29a, kv. 16, Kharkov, all of U.S.S.R.

[21] Appl. No.: 927,878

[22] Filed: Jul. 25, 1978

[51] Int. Cl.[2] ..... F27B 7/38; F27D 15/02

[52] U.S. Cl. ..... 432/80; 432/83; 432/116

[58] Field of Search ..... 432/77–78, 432/80, 81, 83, 116, 237; 34/20; 165/86

[56] References Cited

U.S. PATENT DOCUMENTS

| | | | |
|---|---|---|---|
| 3,822,651 | 7/1974 | Harris et al. | 432/116 |
| 3,829,282 | 8/1974 | Deussner | 432/80 |
| 3,876,367 | 4/1975 | Vorobeichikov et al. | 432/116 |
| 3,976,422 | 8/1976 | Motyczynski et al. | 432/80 |
| 4,137,038 | 1/1979 | Vorobeichikov et al. | 432/77 |

*Primary Examiner*—Henry C. Yuen

*Attorney, Agent, or Firm*—Steinberg and Blake

[57] ABSTRACT

The invention has to do with an apparatus for removing heat from cylinders of the rotary kiln recuperator cooler. The apparatus comprises heat-exchange tubes which are fixed on the lateral surfaces of bow-shaped support members so that they go around the cooler surface along a wave line with a space of variable cross section being formed between the heat-exchange tubes and the surfaces of the cylinders. Such constructional arrangement of the apparatus permits the heat-transfer area to be increased and substantially greater amount of heat to be removed from the surfaces of the cylinders.

2 Claims, 3 Drawing Figures

APPARATUS FOR REMOVING HEAT FROM CYLINDERS OF THE ROTARY KILN RECUPERATOR COOLER

BACKGROUND OF THE INVENTION

I. Field of the application

The invention relates to the practice of cooling the rotary kiln shell, and more particularly, to an apparatus for the removal of heat from the cylinders of the rotary kiln recuperator cooler.

II. Description of the prior art

There is known in the art an apparatus for cooling the shell of a rotary kiln, which comprises a spiral of tubing arranged around the kiln shell with a space being formed therebetween; a coolant such as water circulates through said tubing. The tubes are fixed on support member. Mounted above the tubes are baffles.

Since carrier rings are not provided for in the apparatus construction, it is impossible to ensure strictly concentrical arrangement of the tubes. The misalignment of the tubes results in the impairment of the heat exchange between the kiln shell and the tubes.

In addition, such tube arrangement makes is impossible to conduct the inspection of the kiln shell during operation. Furthermore, the tube-mounting operation requires welding of an appreciable amount of separate half-turns of the tubes. The apparatus dismounting is likewise labour-consuming operation. Due to the absence of either housing or insulation above the baffles, the latter undergo abrupt cooling in the winter time and fail to reflect heat.

There is also known an apparatus for removing heat from the shell of the rotary kiln recuperator cooler, which comprises heat-exchange tubes intended for a coolant to circulate therethrough and fixed sectionwise on support members which concentrically encompass the kiln shell, the heat-exchange tubes being secured on the support members so as to encompass the kiln shell around its periphery with an annular space being formed between the tubes and the housing surface. To enhance the heat-removing efficiency, heat shields are arranged above each tube section or directly on the tubes.

The main disadvantage of the above-described apparatus if applied to the recuperator cooler, lies in its low cooling efficiency which is due to insufficiently developed heat-transfer area of the tubes. In addition, the apparatus of this type is complicated for maintenance and repair, the tube heat shields making the cooler inspection difficult.

It is an object of the invention to provide an apparatus for removing heat from cylinders of the rotary kiln recuperator cooler, which will permit the heat-transfer area thereof to be increased.

Another object of the invention is to provide an apparatus of the type permitting the mounting and servicing of the heat-exchange tubes to be substantially simplified.

These and other objects and features of the invention are attained in an apparatus for removing heat from cylinders of the rotary kiln recuperator cooler, comprising heat-exchange tubes intended for a coolant to circulate therethrough and fixed sectionwise on bow-shaped support members vertically arranged lengthwise of the cooler, according to the invention, the heat-exchange tubes are fixed on the lateral surfaces of the bow-shaped support members so as to go around the cooler surface along a wave line with a space of variable cross section being formed therebetween. Owing to such arrangement of the heat-exchange tubes, as well as due to the space formed between the surfaces of the cylinders and the heat-exchange tubes being of variable cross section, the heat-transfer area is substantially increased and, consequently, a greater amount of heat is removed from the cooler.

This is explained by the fact that the heat-transfer intensity is influenced by the surface area of the heat-exchange tubes rather than by the distance thereof from the surfaces of the cooler cylinders.

Moreover, with the space between the heat-exchange tubes and the surface of the cooler cylinders being of variable cross section, the apparatus servicing becomes easier.

It is preferable to mount on the heat-exchange tubes heat-removing elements rotatable about their axes, made of a high-temperature-resistant material and periodically brought into contact with the surfaces of the cooler cylinders.

This will intensify the rate of heat removal from the cooler effected by the heat-exchange tubes.

BRIEF DESCRIPTION OF THE DRAWINGS

The invention will be further described, by way of example only, with reference to the accompanyings drawings, in which.

DETAILED DESCRIPTION OF THE PREFERRED EMBODIMENT

Figure 1:
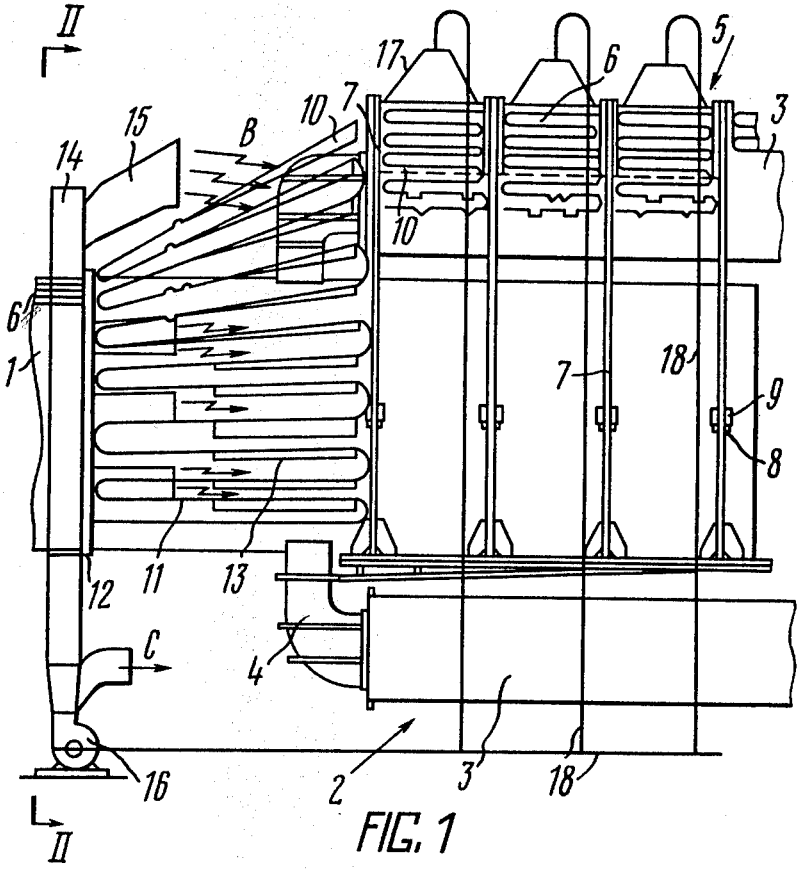
FIG. 1 is a side view of a part of a rotary kiln, as seen from the discharge end thereof, provided with a recuperator cooler around which there is arranged an apparatus for removing heat from the cooler cylinders, according to the invention.

Referring now to the above drawings, and to FIG. 1 in particular, there is shown therein a rotary kiln 1 at the discharge end of which there is mounted a recuperator cooler 2 whose cylinders 3 are concentrically arranged around the kiln discharge end and connected to the kiln I through branch pipes 4.

The hot burned material from the kiln I is passed through the branch pipes 4 to the cylinders 3 where it is cooled by a flow of air supplied therein. The cooled material is then transferred onto a conveyor (not shown). In the course of operation the red-hot cylinders give off a great amount of heat lost to the atmosphere. To collect the wasted heat, an apparatus 5 for removing heat from the cylinders 3 of the cooler 2 is arranged around the cylinders 3.

The apparatus 5 according to the invention comprises heat-exchange tubes 6 intended for a coolant to circulate therethrough. These tube are secured in sections on the lateral surface of bow-shaped support members 7 arranged lengthwise of the cooler 2.

Figure 2:
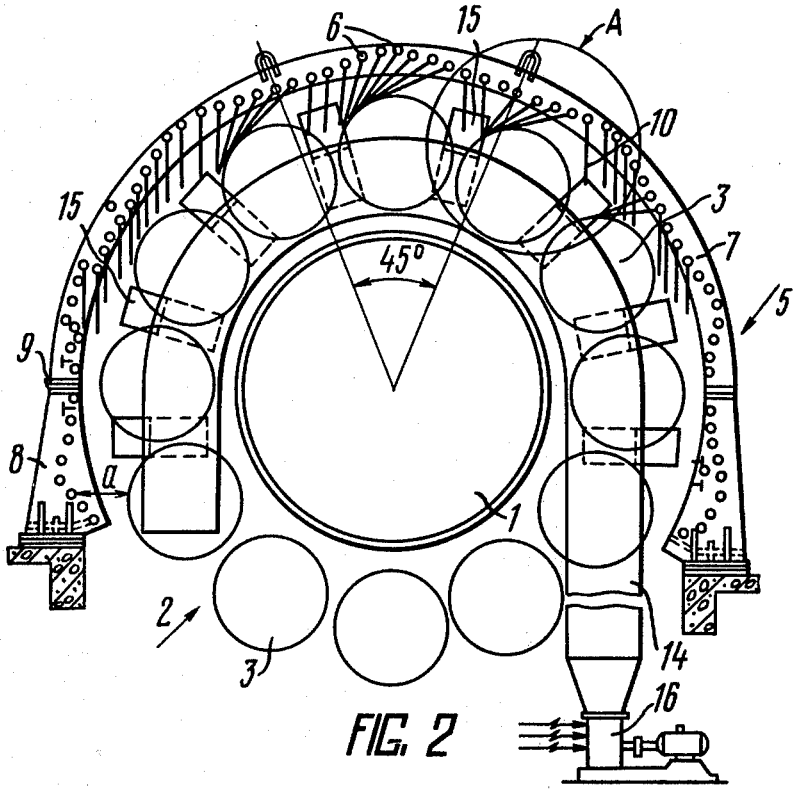
FIG. 2 is a cross-section taken along line II—II of FIG. 1.

Each of the support members 7 is made split and consists of two parts, an upper part in the form of a bow, such as shown in FIG. 2, and a lower part bearing such as shown at 8 in FIG. 2, connected scarfwise such as shown at 9 to the upper bow-shaped part. The heat-exchange tubes 6 are secured on the lateral surfaces of the support elements 7 so that they go around the surface of the cooler 2 along a wave line with a space "a"

of variable cross-section being formed between the surfaces of the cylinders 3 and the heat-exchange tubes 6. The tube arrangement along a wave line and the provision of a space having variable cross section permits the heat-transfer area to be increased.

Figure 3:
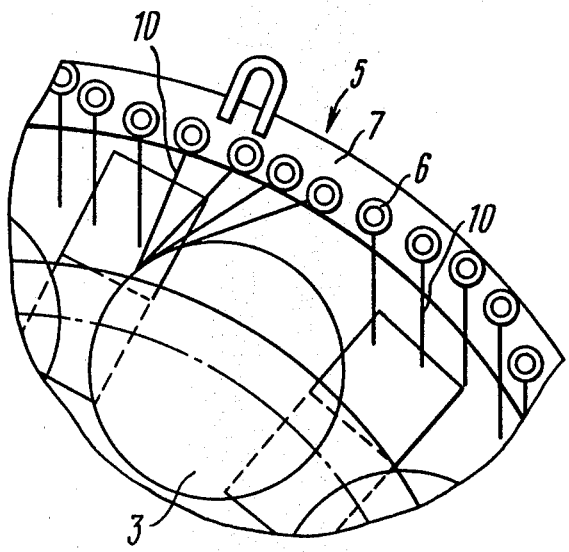
FIG. 3 is a view of a unit A of FIG. 2 (heat-removing plates mounted on the heat-exchange tubes).

Mounted for axial rotation on the heat-exchange tubes 6 (FIG. 3) are heat-removing elements 10 made in the form of plates from high-temperature-resistant material and periodically brought into contact with the surfaces of the cylinders 3 of the cooler 2. Owing to the fact that the tubes 6 are arranged along a wave line, the heat-transfer area is substantially increased, thereby enabling greater amount of heat to be removed from the surfaces of the cylinders 3.

To effect cooling of the branch pipes 4 (FIG. 1), the apparatus of the invention is provided with a system of heat-removing tubes II, with the intertubular space being not less than one time the tube diameter. Each tube II has one of its end fixed on a ring-shaped support member 12 mounted on the shell of the kiln I, the other end thereof being fixed on the last, as viewed in the direction away from the kiln, support member 7. The surface of the tubes II is encompassed by screens 13. Mounted around the shell of the kiln I is an air line 14 branched at 15 in the direction of the discharge branch pipes 4. The direction of air flow is indicated in the drawing by arrow "B". The air line 14 is connected with a blast fan 16.

Mounted around the cylinders is an insulating housing 17. A flow of hot air sucked out by the blast fan 16 from the space formed between the housing 17 and the cylinders 3 is then passed through piping 18 to be used for blasting or pressure charging of the branch pipes 4 and cylinders 3 of the cooler 2.

The direction of hot air flow is indicated in the drawing by arrow "C".

The apparatus according to the invention for removing heat from the cylinders of the rotary kiln recuperator cooler functions as follows.

The heat radiated by the upper part of each cylinder 3 of the cooler 2 is absorbed by the surface of the heat-exchange tubes 6, whereas the heat radiated by the lower part of each cylinder 3 is absorbed by the rotatable heat-removing elements 10.

When found in the interspaces between the cylinders 3, the elements 10, mounted for axial rotation on the heat-exchange tubes 6, undergo pendulum-like swinging movements thereby taking up heat from the hottest part of the cooler and transfer it by convection and radiation to the heat-exchange tubes 6. Then, as the elements 10 perform their next turning movement, they are brought into contact with the hot surface of the cylinders 3 and transfer heat to the tubes 6, thus functioning as the heat-donducting elements.

To enable cooling of the discharge branch pipes 4 of the cooler 2 and to step up removal of heat from the cylinders 3, air is periodically supplied alternatively to the discharge branch pipes 4 and to the heat-removing elements 10. To facilitate this operation, the branch pipes 15 are mounted on the air line 14 so as to face the discharge branch pipes 4 of the cooler 2. As the cooler rotates, air streams are flown out from the branch pipes 15 to periodically blow off the branch pipes 4 and elements 10.

As a result, the cylinders 3 are subjected to blowing, giving off heat to be removed therefrom.

Air blowing is carried out by means of the air fan 16 which sucks in air from outside. If need be, the system of the air line 14 can function on the basis of recirculation, sucking in the air devoid of heat given off to the heat-exchange tubes 6. Recirculation is effected by means of intake pipes. In the regions where the design temperature of the outside air is lower, for example, than minus 30° C., the apparatus of the invention can be enclosed in the housing 17.

It has been found that due to fixing of the heat-exchange tubes 6 on the bow-shaped support members 7 along wave line, the heat-transfer area has been increased, as compared to the prior-art apparatus, now less than 1.5 times.

The support members 7 are dismountable together with the heat-exchange tubes 6 owing to the fact that the tubes 6 are attanched directly to the support members 7 and are connected scarfwise, such as shown at 9, to the bearing base 8.

What is claimed is:

1. An apparatus for removing heat from a rotary kiln recuperator cooler having an axis and a plurality of cylinders which have outer surfaces and are arranged circumferentially about the axis, the apparatus comprising:

at least two substantially bow-shaped stationary support members spaced from one another in an exial direction and each having a lateral surface which faces toward a lateral surface of the other support member;

a plurality of heat-exchange tube means through which a coolant is adapted to circulate, said tube means being fixed to said lateral surfaces of said support members such that said tube means are spaced from each other in a substantially circumferential direction and arranged radially outwardly of the cylinders in the vicinity of the latter along a wave line, so that a space of variable dimension is defined between said heat-exchange tube means and the outer surfaces of the cylinders thereby permitting the heat-transfer area to be increased, wherein each of said heat-exchange tubes has an axis; and further comprising a plurality of heat-removing elements which are constituted of a high-temperature resistant material and mounted on each of said heat-exchange tubes for rotation about the axis of the same tube so as to be periodically brought into contact with the outer surfaces of the cylinders.

2. An apparatus as defined in claim 1 further comprising at least one further support member spaced from one of said at least two support members in the axial direction, and a further plurality of said heat-exchange tube means arranged between said further support member and said one support member.

* * * * *